United States Patent [19]

McGarvey et al.

[11] Patent Number: 5,004,632

[45] Date of Patent: Apr. 2, 1991

[54] FIRE RESISTANT TANK CONSTRUCTION

[75] Inventors: David C. McGarvey, San Gabriel; Jerry E. Buffalini, Corona, both of Calif.

[73] Assignee: LRS, Inc., South El Monte, Calif.

[21] Appl. No.: 491,272

[22] Filed: Mar. 9, 1990

Related U.S. Application Data

[62] Division of Ser. No. 331,548, Mar. 31, 1988.

[51] Int. Cl.[5] ..... B05D 1/36; B05D 7/00

[52] U.S. Cl. ..... 427/410; 220/455; 220/468; 427/421

[58] Field of Search ..... 220/1 B, 18, 453, 455, 220/456, 468, 469; 427/236, 386, 410, 421

[56] References Cited

U.S. PATENT DOCUMENTS

| | | | |
|---|---|---|---|
| 810,237 | 1/1906 | Wadsworth . | |
| 1,114,019 | 10/1914 | Morris . | |
| 1,273,195 | 7/1918 | Snyder . | |
| 1,625,765 | 4/1927 | Ratzenstein . | |
| 1,724,582 | 8/1929 | Hart . | |
| 2,460,054 | 1/1949 | Wiggins | 220/18 |
| 2,558,694 | 6/1951 | Speig | 169/4 |
| 2,772,834 | 12/1956 | Swenson et al. | 237/67 |
| 2,864,527 | 12/1958 | Altman et al. | 220/14 |
| 2,869,751 | 1/1959 | Klope et al. | 220/15 |
| 2,931,211 | 4/1960 | McCullough | 220/455 X |
| 3,595,424 | 7/1971 | Jackson | 220/15 |
| 3,666,132 | 5/1972 | Yamamoto et al. | 220/9 LG |
| 3,702,592 | 11/1972 | Gamble | 220/9 R |
| 3,827,455 | 8/1974 | Lee | 137/375 |
| 3,952,907 | 4/1976 | Ogden et al. | 220/18 |
| 3,969,563 | 7/1976 | Hollis | 428/175 |
| 4,376,489 | 3/1983 | Clemens | 220/1.5 |
| 4,651,893 | 3/1987 | Mooney | 220/445 |
| 4,685,327 | 8/1987 | Sharp | 220/469 X |
| 4,697,618 | 10/1987 | Youtt et al. | 137/587 |
| 4,815,621 | 3/1989 | Bartis | 220/1 B |
| 4,826,644 | 5/1989 | Lindquist et al. | 264/71 |
| 4,844,287 | 7/1989 | Long | 220/455 X |
| 4,890,983 | 1/1990 | Solomon et al. | 417/41 |

OTHER PUBLICATIONS

Uniform Fire Code, 1985 Ed., pp. 203–278.
Reliance Tank sales materials (undated)—price list date 1-20-89.
Agape Tank sales materials (dated by postmark Jun. 7, 1989).
Doehrman, Inc.—facsimile dated May 9, 1989.
Safe-T-Tank Corp. sales materials dated 1987—sales materials from Air Boy (Jun. 1988)—advertisement dated Feb., 1987 from KeeSee, "Lube Cube" sales materials dated Jul. 1, 1988.
UL 142 Standard for Safety, Steel Aboveground Tanks (1987).
International Search Report, PCT/US90/01654 dated Mar. 28, 1990.
Husky 1030 Double Diaphragm Pump (1987) instructions and parts list.
"Oil Evacuation System", Aro Corp., (1982).
"½" Waste Oil Evacuation System" (drawing dated Mar. 15, 1987).
"Aro Air Operated Diaphragm Pumps", (1986).
"Aro Lubrication Equipment", (1989) pgs. 31 and 33.
Cla-val co. float control parts list (1977).

*Primary Examiner*—Michael Lusignan
*Attorney, Agent, or Firm*—William W. Haefliger

[57] ABSTRACT

Fire resistant tank apparatus is adapted for transportation and for installation above-ground to receive and dispense a liquid hydrocarbon or hydrocarbons, or the like, and includes a metallic tank having a lightweight wall structure, including an upright side wall or walls, a top wall and a bottom wall; first port structure on the top wall defining access porting to the tank interior; second support beneath the bottom wall to support the tank at an installation site; and fire resistant synthetic resinous material applied as a coating to the outer side or sides of the tank walls, and hardened to define a relatively lightweight shell enclosing the tank, the shell extending into adjacency with the first and second structures, the shell having thickness between about ¼ inch and 1 inch.

12 Claims, 2 Drawing Sheets

FIG. 1.
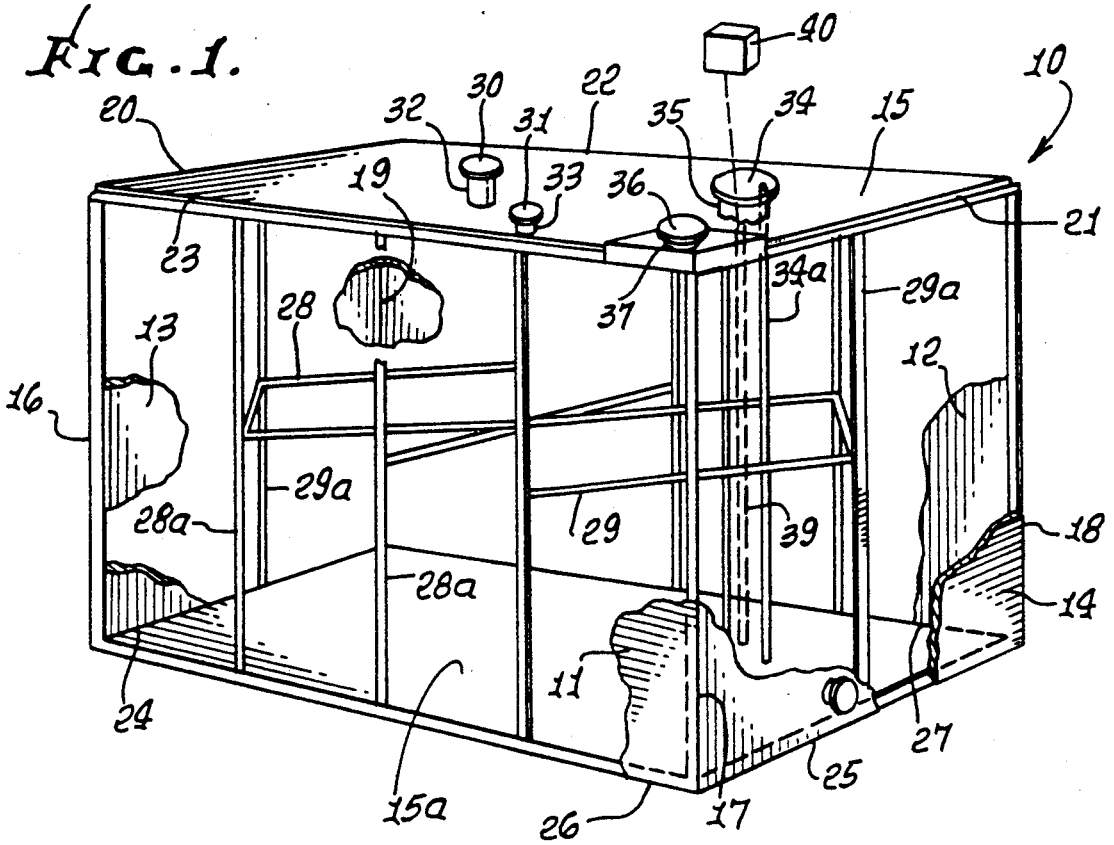
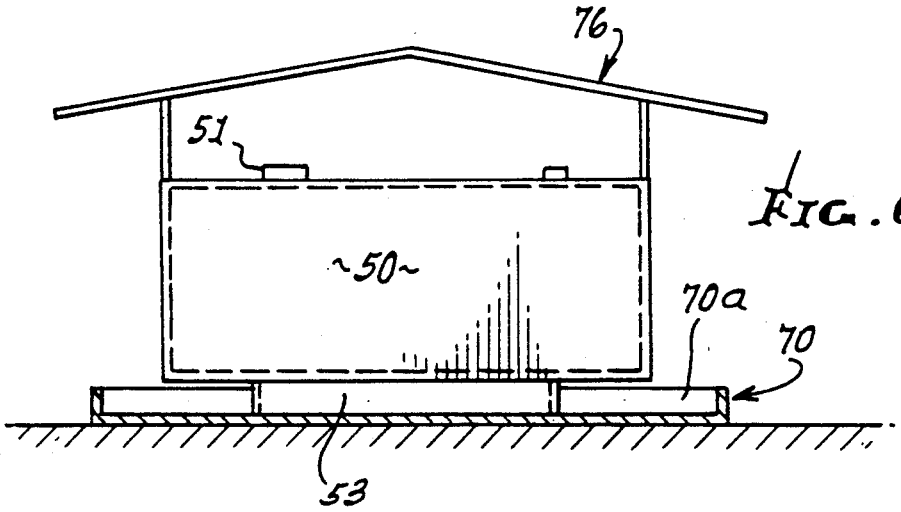
FIG. 6.
FIG. 7.
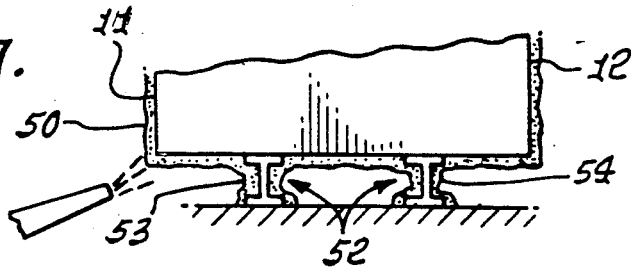

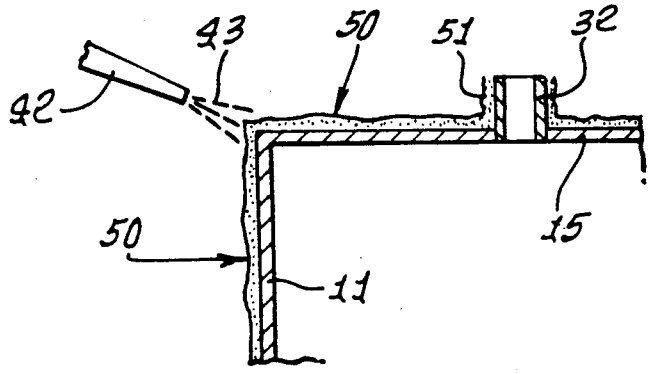
FIG. 2.
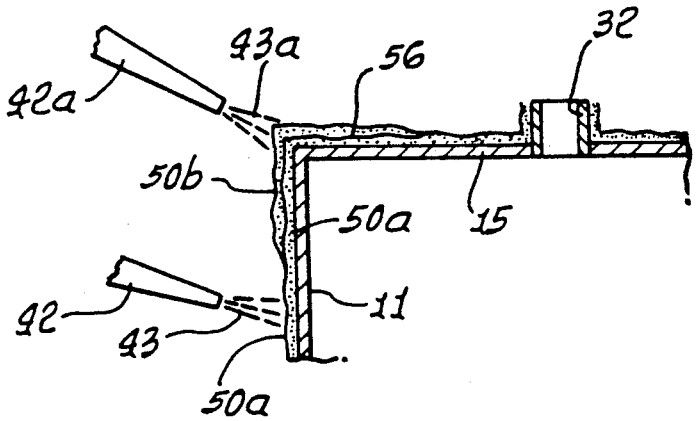
FIG. 3.
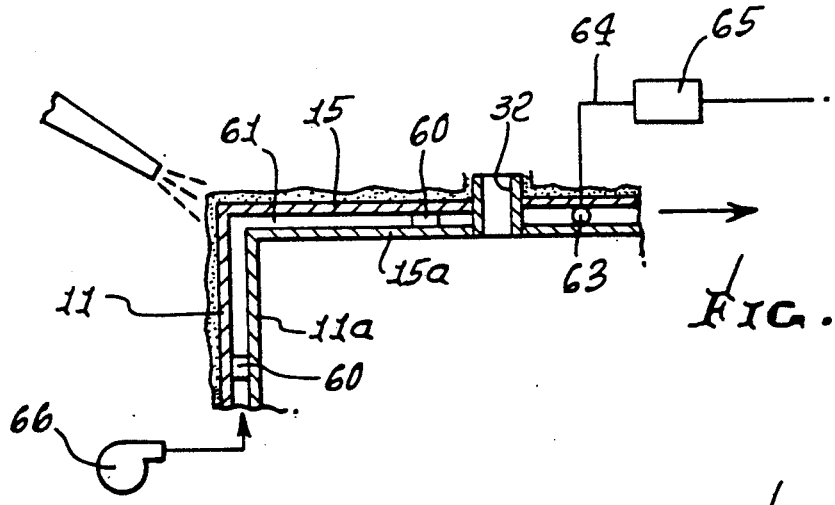
FIG. 4.
FIG. 5a.
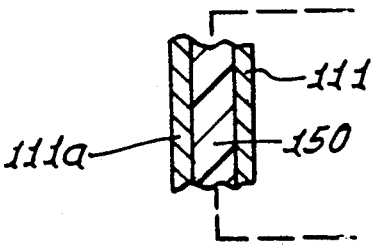
FIG. 5.
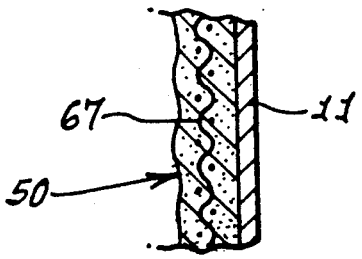

FIRE RESISTANT TANK CONSTRUCTION

This is a division, of application Ser. No. 331,548, filed Mar. 31, 1988.

BACKGROUND OF THE INVENTION

This invention relates generally to tanks for flammable and combustible liquids, and more particularly concerns methods and means for making such tanks fire resistant in above-ground installation environments.

Tanks holding flammable or combustible liquids, such as new and used hydrocarbon products, if installed above ground, can be dangerous if not "fireproofed", i.e., made "fire resistant". For example, if the tanks leak flammable liquid, a fire danger will exist. Fire can weaken the lightweight tank walls and lead to tank collapse and spillage of tank contents.

In the past, such tanks were enclosed in concrete and transported to installation sites; however, the concrete is subject to cracking, which then can allow leakage to the exterior of flammable liquid leaking from the tank itself. Also, the concrete-enclosed tank is extremely heavy and difficult to transport. There is need for method and means to make such tanks fireproof and leak proof in such a way that a relatively lightweight unit is provided, for ease of transportation and installation, and subsequent safety.

SUMMARY OF THE INVENTION

It is a major object of the invention to provide method and means meeting the above need. Basically, the method of providing a fire resistant tank apparatus, for flammable liquid, includes the steps:

(a) providing a metallic tank having upright side wall means, a top wall and a bottom wall, (b) providing first means on the top wall defining access porting to the tank interior, (c) providing second means beneath the bottom wall to support the tank at an installation site, (d) and applying fire resistant coating material onto the tank walls, and allowing the coating material to harden, in situ, to form a shell enclosing the tank, the material applied closely adjacent the first and second means, for preventing flame induced weakening of the tank wall or walls.

As will be seen, the application step is typically carried out by spraying said material:

(i) to form a first thin layer of coating material extending adjacent the tank walls, the first layer allowed to harden, the first layer having an outer surface;

(ii) and subsequently to form a second coating layer extending into contact with the outer surface of the first layer, the second layer then allowed to harden.

Thus, multiple shells of coating material are formed, to permit flexing and installation impacts without cracking.

The sprayable and hardenable fire resistant material typically has an epoxide resin base, and chars when exposed to flame. One example is the sprayable two component intumescent epoxy fireproofing system (CHARTEK) (liquid resin and hardener, mixed with methylene chloride, or 1,1,1,-trichloroethane) supplied by Avco Specialty Materials, Lowell, Mass.

A further safety feature is the construction of the tank walls themselves to have inner and outer sub-walls defining a gap therebetween, and including means to sense hydrocarbon vapor in the gap. Thus, leakage may be detected prior to access of leaking fluid to the protective shell.

In its apparatus aspects, the fire resistant tank apparatus (to hold and dispense flammable liquid such as hydrocarbon fuel, or the like) comprises:

(a) a metallic tank having upright side wall means, a top wall and a bottom wall, (b) first means on the top wall defining access porting to the tank interior, (c) second means beneath said bottom wall to support the tank at an installation site, (d) and fire resistant material sprayed onto the tank walls, and hardened in situ to define a shell enclosing the tank, the shell extending into adjacency with the first and second means, for extra safety, (e) the shell having thickness between about ¼ inch and 1 inch.

As referred to, the shell typically comprises:

(a) a first sub-shell extending into contact with the tank wall, and hardened in situ, the first sub-shell having an outer surface, and (b) a second sub-shell extending into contact with the first sub-shell outer surface and hardened in situ.

Additional sub-shells may be formed about the two sub-shells referred to. Also, the tank walls may include inner and outer sub-walls defining a gap therebetween, and means may be provided to sense hydrocarbon vapor in the gap. Also, fireproofing material may be employed in the gap.

These and other objects and advantages of the invention, as well as the details of an illustrative embodiment, will be more fully understood from the following specification and drawings in which:

DRAWING DESCRIPTION

FIG. 1 is a perspective view of a metallic tank, prior to spraying of fire resistant material onto the tank walls;

FIG. 2 is a fragmentary section showing spray-on of fireproof coating material;

FIG. 3 is a view like FIG. 2, but showing spray-on of multiple layers of the fireproof coating material;

FIG. 4 is a view like FIG. 2, but showing a multi-wall tank construction;

FIG. 5 is a fragmentary section showing use of mesh embedded in the sprayed on fireproofing material;

FIG. 5*a* is a fragmentary section showing a filled gap between a double wall tank structure;

FIG. 6 is a side elevation showing the fireproofed tank supported in a shallow receptacle at an installation site; and FIG. 7 is an end view of a tank, showing support means being sprayed with fire-resistant material.

DETAILED DESCRIPTION

In FIG. 1, a tank 10 to be made fire resistant, includes upright front and rear side walls 11 and 12, upright end walls 13 and 14, and horizontal top and bottom walls 15 and 15*a*. Such walls may consist of steel and be less than one inch thick, for lightweight tank construction enhancing portability, for installation above ground at different sites, as desired. Typically, the steel walls about 10 gauge (⅛ to ¼ inch thick). The tank length between walls 13 and 14 may typically be about 10–15 feet. The walls are typically interconnected by welds at their junctions, as at 16–19, 20–23, and 24–27. Internal braces may be provided, as at 28–29, and vertical braces at 28*a* and 29*a*. The tank side walls may define a cylindrical tank, which may be considered to have side and end walls integrated into a cylindrical wall.

Located in the top wall or walls are bungs 30 and 31 which are removable from upright stub pipes 32 and 33, respectively. A pipe cover 34 is rearwardly attached to the top of the stub pipe 35; and a vent cover 36 is attached to stub pipe 37. The upright stub pipes (providing means to define access porting to the tank interior) are welded to the top wall and provide access to the tank interior via ports in the top wall. Dipsticks (as at 34*a*) may thus be inserted into the tank to measure the level of liquid hydrocarbon, i.e., flammable or combustible liquid (such as fuel) in the tank. Monitor means 39 may be installed in the tank via one of the access ports to sense liquid level and transmit corresponding electrical signals to external apparatus 40 that registers the liquid level for ready viewing.

Referring to FIG. 2, it shows a nozzle 42 spraying fire resistant synthetic resinous material at 43 onto the tank walls, to a thickness between about ¼ inch and 1 inch That material, which may typically be epoxide resin based, is allowed to harden in situ, to form a relatively lightweight shell 50 enclosing and adhering to the metallic tank, on all sides, ends, and top and bottom The material is sprayed closely adjacent, and typically onto and about the stub pipe, as at 51, i.e., adherent to pipe 32, at the top wall, and is also sprayed closely adjacent (i.e. onto and about the sides of) support means such as the supports 52 integral with the bottom wall. See shell layers 53 and 54 on the sides of supports 52, in FIG. 7. The material forming shell 50 may be otherwise applied to the tank wall or walls; however, spraying is preferred as it allows troweling of the material, for finishing.

If the shell thickness is greater than about 1 inch, the total unit weight becomes too great for ease of transport; and if the shell thickness is less than about ¼ inch, the desired "fireproofing" is reduced to an unacceptable level—i.e., fireproofing effect becomes too small.

In order that the material 43 being sprayed on may cling to, the upright metal walls without sagging out of position, and also to have optimum fireproofing effect, it has typically an epoxide resin base, and chars when exposed to flame. One example is the sprayable two component intumescent epoxy fireproofing system (CHARTEK) (liquid resin and hardener, mixed with methylene chloride, or 1,1,1,-trichloroethane) supplied by Avco Specialty Materials, Lowell, Mass.

FIG. 3 shows a nozzle 42 spraying fireproofing material at 43 onto the tank wall 11 to form a first layer 50*a*, which is allowed to harden or cure, in situ; and a second nozzle 42*a* (or the same nozzle 42) is then used to spray fireproofing material 43*a* onto the layer 50*a*, to form a second layer 50*b*, which is allowed to harden, in situ. The combination of shells or layers 50*a* and 50*b* form the composite shell 50 having thickness between ¼ and 1 inch. Dual shells as defined, or even more shells in the composite, provide an even stronger, more leak resistant and fire resistant unit. An interface between the sub-shells 50*a* and 50*b* appears at 56 and each applied coat is troweled before application of the next coat.

Prior to spraying the first layer 50*a* into the tank walls, the latter are preferably sand blasted for cleaning purposes; and a primer coat is applied to the raw metal surface to resist rust formation. The primer coat may, for example, consist of polyamide epoxy resin, such as AMERON 71, SUBOX A8051, or VAL-CHEM 13-R-56, or ethyl silicate inorganic zinc (such as DIMET-COTE 6).

FIG. 4 shows a tank consisting of outer tank walls 11–16 as referred to above, and inner metallic walls 11*a*–16*a*, as shown. Walls 11*a*–16*a* are spaced from the respective walls 11–16, as by local spacers 60, to provide a gap or space 61 between the walls. Any fluid leaking from the tank interior via the inner walls passes first to the gap 61, and may be detected as by a sensor 63 sensing volatile gases emitted by the flammable hydrocarbon The sensor or detector is connected at 64 to an external monitoring device 65, as shown. Flow of air or flammable liquid in the gap may be induced, as by a blower 66.

FIG. 5 shows a strengthening mesh 67, for example made of wire, embedded in the shell 50 forward about the tank walls.

FIG. 5*a* shows the tank wall means (side wall or walls an/or top wall and/or bottom wall, as referred to) to include for example inner and outer sub-walls 111 and 111*a*. A gap between the sub-walls contains fire resistant material 150 (as for example of the type described above) to effectively define a shell including the inner sub-wall 111, the shell thickness between ¼ inch and 1 inch. The shell may otherwise consist of an insulative sheet such as styrofoam or flowable fireproof material, such as VERMICULITE. Broken lines 115 and 116 show extensions of such structure to the top and bottom wall construction of the tank.

Properties of the "CHARTEK" fireproofing system referred to above are as follows

TABLE 1

CHARTEK MECHANICAL PROPERTIES

| Property | ASTM Reference | Value | Conditions |
|---|---|---|---|
| Tensile Strength | D638 | 2750 psi<br>$19.0 \times 10^6$ *PA* | Room Temp. |
| Modulus | | $3.42 \times 10^5$ *psi*<br>$2.36 \times 10^9$ *PA* | Room Temp. |
| Compressive Strength | D659 | 6342 psi<br>$43.7 \times 10^6$ *PA* | Room Temp. |
| Modulus | | $1.89 \times 10^5$ *psi*<br>$1.3 \times 10^9$ *PA* | Room Temp. |
| Impact Strength (unsupported, unmeshed) | D256 | 0.42 ft lbs/in<br>0.22 J/cm | Room Temp. notched |
| | | 0.71 ft lbs/in<br>0.38 J/cm | Room Temp. unnotched |
| Flexural Strength | D790 | 4290 psi<br>$29.6 \times 10^6$ *PA* | Room Temp. |
| Modulus | | $3.32 \times 10^5$ *psi*<br>$2.3 \times 10^9$ *PA* | Room Temp. |
| Hardness | Shore D | 83 | D Scale |
| Bond Strength | D1002 | 1578 psi<br>$10.9 \times 10^9$ *PA* | Primed, room temp. |

TABLE II

PHYSICAL PROPERTIES

| Property | ASTM Reference | Value | Conditions |
|---|---|---|---|
| Density | D792 | 79 lbs/ft$^3$<br>1.27 g/cc | After spraying |
| Thermal | C177 | 2.10 BTU in/ft$^2$ hr °F. | At 68° F. |

TABLE II-continued

PHYSICAL PROPERTIES

| Property | ASTM Reference | Value | Conditions |
|---|---|---|---|
| Conductivity | | 0.302 W/m °C. | At 20° C. |
| | | 1.96 BTU in/ft$^2$ hr °F. | At 154° F. |
| | | 0.283 W/m °C. | At 68° C. |
| Thermal Expansion With Mesh | D696 | $20.5 \times 10^{-6}$ in/in °F. | From −70° F. |
| | | $36.9 \times 10^{-6}$ cm/cm °C. | (−57° C.) to |
| Thermal Expansion Without Mesh | | $36.4 \times 10^{-6}$ in/in °F. | 150° F. |
| | | $65.5 \times 10^{-6}$ cm/cm °C. | (66° C.) |
| Specific Heat | Differential Scanning Calorimetry | 0.33 BTU/lbm °F. | At 86° F. |
| | | 1.38 J/Kg °C. | At 30° C. |
| | | 0.23 BTU/lbm °F. | At 500° F. |
| | | 0.96 J/kg °C. | At 260° C. |
| Oxygen Index | D2836 | 32 | |
| Flash Point | D92 | | |
| Component I | | Over 200° F. (93° C.) | Open cup |
| Component II | | Over 200° F. (93° C.) | Open cup |
| Viscosity | | | |
| Component I | | 285000 CPS | At 100° F. (37.8° C.) |
| Component II | | 60000 CPS | At 100° F. (37.8° C.) |
| Gas (Nitrogen) Permeability | D1434 | $1.6 \times 10^{-9} \frac{\text{in}^3\text{ (STP) in}}{\text{sec. in}^2\text{ Atm}}$ | At 68° F., 1.51 Atm |
| | | $1.36 \times 10^{-10} \frac{\text{cm}^3\text{ (STP) cm}}{\text{sec. cm}^2 \cdot \text{cmHg}}$ | At 20° C., 1.53 Bar |
| Water Vapor Transmittance | E96 Procedure B | $1.013 \times 10^{-3}$ gr/hr ft$^2$ | At 73° F. (22.8° C.) |
| | | $4.07 \times 10^{-1}$ g/hr m$^2$ | and 50% RH |
| Pot Life | | 55 minutes | At 70° F. (21° C.) |
| Gel Time | | 8 hours | At 60° F. (16° C.) |
| | | 4 hours | At 80° F. (27° C.) |
| Cure Time to Shore A of 85 | | 18 hours | At 60° F. (16° C.) |
| | | 8 hours | At 80° F. (27° C.) |
| Color | | Grey | |
| Maximum Service Temperature | | 150° F. (66° C.) | Continuous Use |

Finally, FIG. 6 shows a fireproof material coated tank, stub pipes, and supports, installed at a work site, in a basin 70 supported on the ground 71. The basin forms a collection zone 73 beneath the tank to collect any possible leakage of flammable liquid. A hood 76 may be provided over the tank and basin to prevent rainwater accumulation in the basin.

We claim:

1. In the method of providing fire resistant tank apparatus adapted for transportation and installation above ground to receive and dispense a liquid hydrocarbon or hydrocarbons, or the like, the steps that include:

(a) providing a metallic tank having lightweight upright side wall means, a top wall and a bottom wall, (b) providing first means on the top wall defining access porting to the tank interior, (c) providing second means projecting beneath said bottom wall to support the tank at an above ground installation site, (d) applying fire resistant material onto the tank walls, and allowing the said material to harden in situ to form a relatively lightweight shell enclosing the tank, said material applied closely adjacent said first and second means, (e) said application step continued to provide shell thickness between about ¼ inch and 1 inch, (f) said fire resistant material being characterized as charring in response to flame impingement thereon, (g) the tank walls having thickness maintained between about ¼ inch and 1 inch, (h) said fire resistant material being maintained free of retention to said tank by metallic bands with clips.

2. The method of claim 1 wherein said application includes spraying which is carried out:

(i) to form a first layer of material extending adjacent exterior sides of the tank walls, the first layer allowed to harden, the first layer having an outer surface;

(ii) and subsequently to form a second layer extending into contact with said outer surface of the first layer, the second layer then allowed to harden.

3. The method of claim 1 wherein said material has an epoxide resin base.

4. The method of claim 1 wherein said fire resistant material consists of the product CHARTEK.

5. The method of claim 1 including constructing the tank walls to have inner and outer sub-walls defining a gap therebetween, and including providing means located to sense hydrocarbon vapor in the gap.

6. The method of claim 1 wherein said first means includes at least one upright pipe stub via which access may be gained to the tank interior, said application including spraying carried out to spray said material closely protectively adjacent and about the pipe stub.

7. The method of claim 2 including preliminarily sand blasting the tank walls, and applying a primer coat thereto.

8. The method of claim 1 wherein the tank walls include inner and outer subwalls defining a gap therebetween, and including applying fire resistant material to substantially fill said gap.

9. The method of claim 1 wherein said fire resistant material consists essentially of synthetic resin.

10. The method of claim 1 wherein said fire resistant material consists of solid, cured, hydrocarbon, which is flame charred.

11. The method of claim 1 including supporting said tank apparatus above ground by said second means which comprises supports positioned to project downwardly beneath said bottom wall, said supports having side surfaces, and substantially completely coating said side surfaces with said fire resistant material.

12. In the method of providing fire resistant tank apparatus adapted for transportation and installation above ground to receive and dispense a liquid hydrocarbon or hydrocarbons, or the like the steps that include:

(a) providing a metallic tank having lightweight upright side wall means, a top wall and a bottom wall, (b) providing first means on the top wall defining access porting to the tank interior, (c) providing second means projecting beneath said bottom wall to support the tank at an above ground installation site, (d) applying fire resistant material onto the tank walls, and allowing the said material to harden in situ to form a relatively lightweight shell enclosing the tank, said material applied closely adjacent said first and second means, (e) said application step continued to provide shell thickness between about ¼ inch and 1 inch, (f) said fire resistant material being characterized as heat degrading in response to flame impingement thereon, (g) the tank walls having thickness maintained between about ¼ inch and 1 inch, (h) said fire resistant material being maintained free of retention to said tank by metallic bands with clips.

* * * * *